US006438927B1

(12) United States Patent
Focke et al.

(10) Patent No.: US 6,438,927 B1
(45) Date of Patent: Aug. 27, 2002

(54) PROCESS AND APPARATUS FOR PRODUCING (CIGARETTE) PACKS

(75) Inventors: Heinz Focke; Martin Stillor; Dirk Förstmann, all of Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/420,897

(22) Filed: Oct. 18, 1999

(30) Foreign Application Priority Data

Oct. 19, 1998 (DE) ..... 198 47 918

(51) Int. Cl.[7] ..... B65B 53/02
(52) U.S. Cl. ..... 53/415; 53/416; 53/419
(58) Field of Search ..... 53/397, 375.9, 53/398, 399, 410, 412, 415, 416, 419, 589, 136.1, 135.1, 135.2

(56) References Cited

U.S. PATENT DOCUMENTS

| | | | | |
|---|---|---|---|---|
| 2,736,448 A | | 2/1956 | Winn | |
| 2,923,110 A | * | 2/1960 | Tamarin | 53/136.1 |
| 3,873,394 A | | 3/1975 | Pearl et al. | |
| 4,468,274 A | | 8/1984 | Adachi | |
| 4,887,408 A | * | 12/1989 | Mattei et al. | 53/412 |
| 5,613,344 A | * | 3/1997 | Osti et al. | 53/375.9 |
| 5,645,669 A | | 7/1997 | Crankshaw et al. | |
| 5,694,738 A | * | 12/1997 | Shigeta | 53/234 |

FOREIGN PATENT DOCUMENTS

| | | |
|---|---|---|
| DE | OS 20 64 334 | 7/1971 |
| DE | OS 21 50 167 | 4/1972 |
| DE | 40 40 261 A1 | 6/1991 |
| DE | 43 03 063 A1 | 8/1993 |
| GB | 21 57 260 A | 10/1985 |
| WO | WO 99/28195 | 6/1999 |

* cited by examiner

*Primary Examiner*—Scott A. Smith
*Assistant Examiner*—Nathaniel Chukwurah
(74) *Attorney, Agent, or Firm*—Troutman Sanders LLP; Todd Deveau; Wm. Brook Lafferty

(57) ABSTRACT

Process and apparatus for producing cigarette packs (10) which are provided with a band (13) which butts against the outside of the packs and is fastened by glue. The band (13), which is positioned on the cigarette pack (10) and glued, is pressed onto the cigarette pack (10) by a pressure-exerting subassembly (26), heat being transmitted by a heated pressure-exerting member (29) for the purpose of setting the glue.

19 Claims, 3 Drawing Sheets

PROCESS AND APPARATUS FOR PRODUCING (CIGARETTE) PACKS

The invention relates to a process for producing (cigarette) packs having a band fastened on at least one pack surface by adhesive bonding. The invention also relates to an apparatus for carrying out the process.

Cigarette packs are usually provided with a band, that is to say a strip-like blank made of paper or similar thin material. This band is usually a revenue stamp. However, it is also possible for the band to be used as a means for closing the pack.

With the increasingly higher outputs and resulting higher cycle speeds of tho packaging machines, there are problems in terms of providing the bands on the packs in a correctly positioned and stable manner. The bands are usually fastened on the pack on at least one pack surface, but in most cases "around a corner", by adhesive bonding.

The object of the invention is to provide band on (cigarette) packs in a stable manner within a relatively short period of time.

In order to achieve this object, the process according to the invention is characterized in that, (immediately) once the band has been provided on the pack, heat and pressure are applied to the hand in order to fix the same.

The invention is based on the finding that problems with providing the bands arise, in particular, in that the glue or adhesive for fastening the band does not set sufficiently quickly. For this purpose, in particular heat is applied to the band, and thus to the glue which has not yet set, to be precise in conjunction with pressure. This means that, within an extremely short period of time, the glue can set to such an extent that the band is connected to the pack in a stable manner.

The apparatus for carrying out the process is designed such that, in the immediate region of a band subassembly for applying the (glued) band to the pack, or following the band apparatus in a separate station, a heated pressure-exerting element acts upon the bands, that is to say presses said bands onto the pack with the transmission of heat. The pressure-exerting element preferably comprises a circulating carrier with a plurality of, namely in particular two, pressure-exerting segments which can be moved with the correct timing into a position with temporary abutment -against the pack in the region of the band. The pressure-exerting element or the segments may be designed such that the band is subjected to folding at the same time as heat and pressure are transmitted, if namely a leg of the band is to be folded into the plane of another pack surface.

Further (special) features of the invention are explained in more detail below with reference to exemplary embodiments of the apparatus which are illustrated in the drawings, in which.

Figure 1:
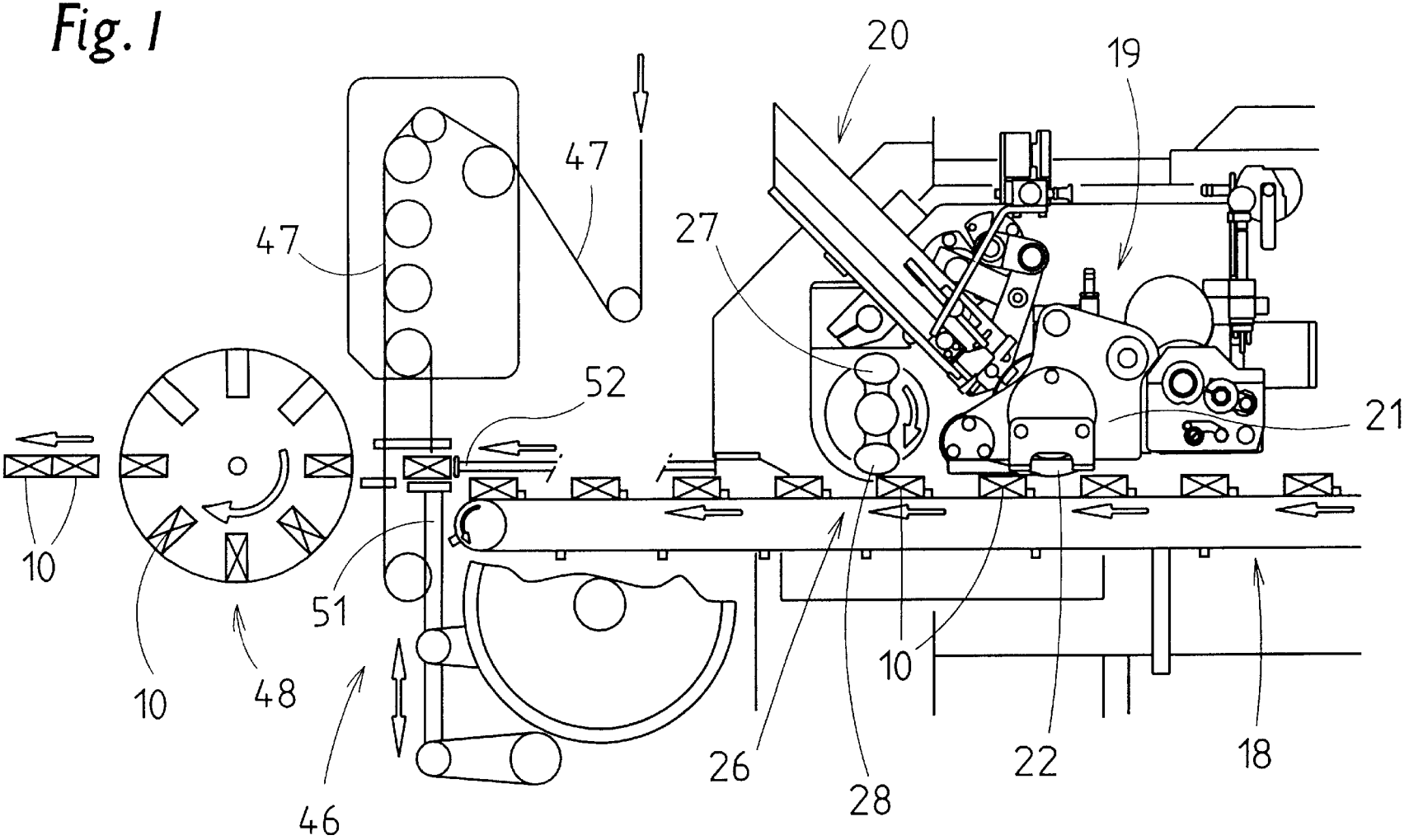
FIG. 1 shows part of a packaging machine in a schematic side view.

The exemplary embodiments of the drawings are concerned with the production and completion of cigarette packs 10. These are of the hinge-lid-box type, that is to say with a (bottom) box part 11 and a lid 12. The box part 11 and lid 12 are connected pivotably to one another in the rear region.

The cigarette pack 10 is to be provided with a band 13. In the present case, this is to be applied to a front side 14 of the cigarette pack 10, to be precise in the region of a closure edge 15 between the box part 11 and lid 12. In the present case, the band 13 is dimensioned and arranged so as to form a leg 16 which projects laterally beyond the front side 14 and has to be folded over into the plane of a side surface 17. The front side 14 is directed upwards for the purpose of receiving the band 13.

According to FIG. 1, the cigarette packs 10 are transported at regular intervals from one another on a pack conveyor 18—in particular a (toothed) belt with protrusions. The front side 14 is directed upwards. A band apparatus 19 is located above the movement path of the cigarette packs 10. Said band apparatus removes individual bands 13 from a band magazine 20. The bands are provided on one side with glue in the region of a glue unit 21. The bands 13 which have hewn prepared in this way are fed to the continuously conveyed cigarette packs. A band dispenser 22 transfers the individual hands 13 to in each case one cigarette pack 10, the glued side being directed towards the cigarette pack 10. In the present case, the elongate, rectangular bands are positioned on the cigarette packs 10 such that a leg 16 projects beyond the cigarette packs 10 to the rear. The relative positioning of the cigarette packs 10 in the region of the pack conveyor 18 is selected such that the longitudinal extent is oriented transversely to the conveying direction, that is to say an elongate side surface 17 forms the rear side of the cigarette packs 10.

The pack conveyor 18 may be designed as a bolt conveyor. In the case of the present exemplary embodiment, the cigarette packs 10 are transported an a fixed base 23 by an endless conveyor, namely by a chain 24 with carry-along elements 25 arranged at regular intervals.

Following the band apparatus 19, the cigarette packs 10 are moved past a stabilizing subassembly, namely past a pressure-exerting subassembly 26. The latter transmits pressure and/or heat to the cigarette packs 10 in the region of the band 13, with the result that the glue sets within an extremely short period of time, while the band 13 is fixed in the predetermined position by the transmission of pressure. For this purpose, the pressure-exerting subassembly 26 comprises a plurality of, namely two, segments 27, 28. These run along a circular path in time with the machine. In each case convexly projecting pressure-exerting members 29 of the segments 27, 28 come into abutment against the band 13, the pressure-exerting members 29 rolling on the cigarette pack 10 or on the band 13 on account of the movements in the same direction.

The segments 27, 28 transmit heat to the bands 13, to be precise contact heat, by way of the pressure-exerting members 29. The segments 27, 28 comprise a housing 30 which forms the pressure-exerting member 29 on the radially outer side. Arranged within the housing 30 is a heating means, namely a heating cartridge 31 in an elongate cutout of the pressure-exerting member 29. The heat cartridge 31 or the pressure-exerting member 29 is assigned a thermostat 32 which establishes the temperature in the region of the pressure-exerting member 29 and is connected to a central control unit.

Two diametrically opposite segments 27, 28 are connected to a segment carrier 33 which is arranged on a driven shaft 34. The latter is driven in time with the machine.

Figure 2:
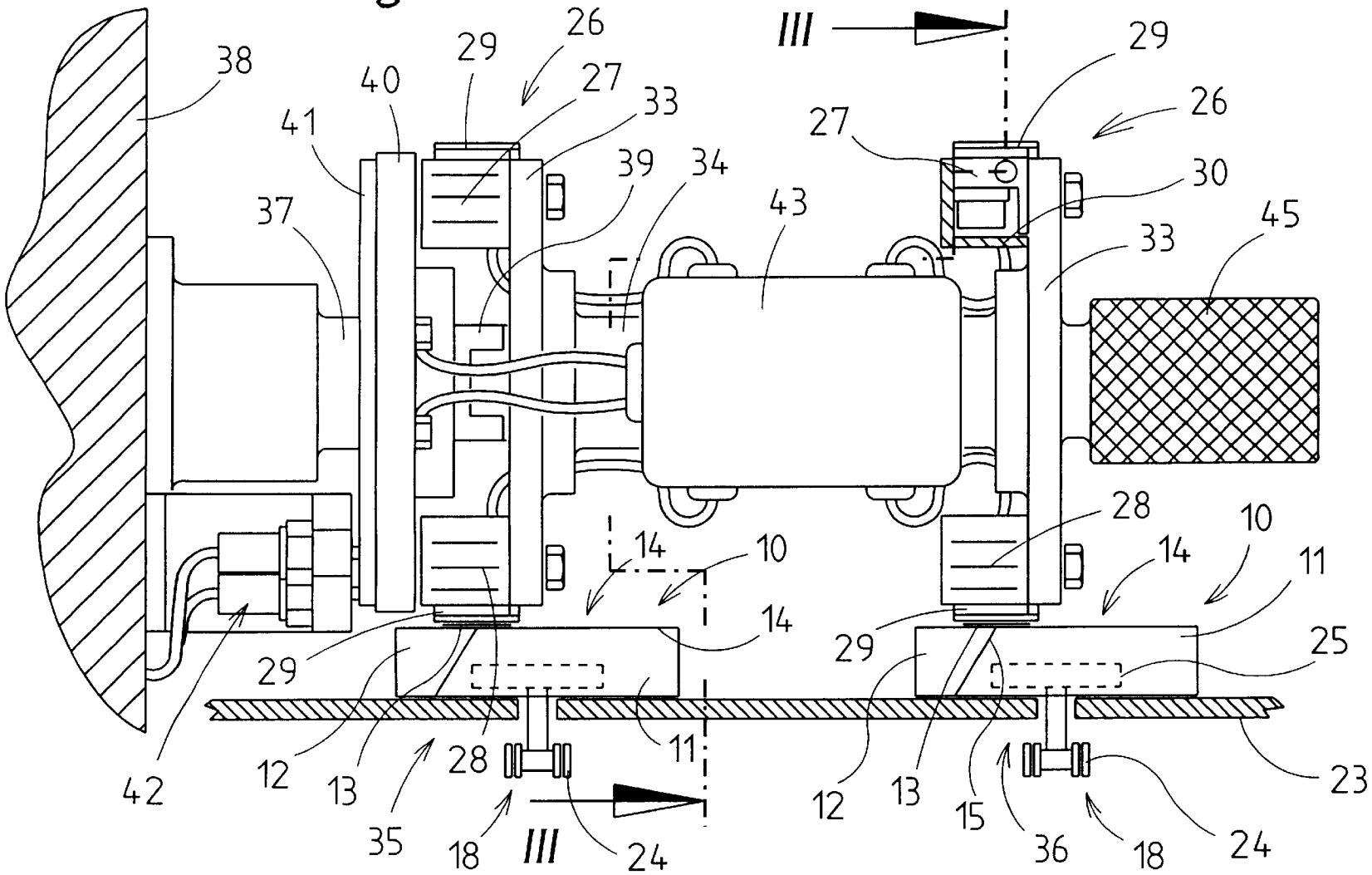
FIG. 2 shows, on an enlarged scale, a pressure-exerting subassembly for the bands in a transverse view.
Figure 3:
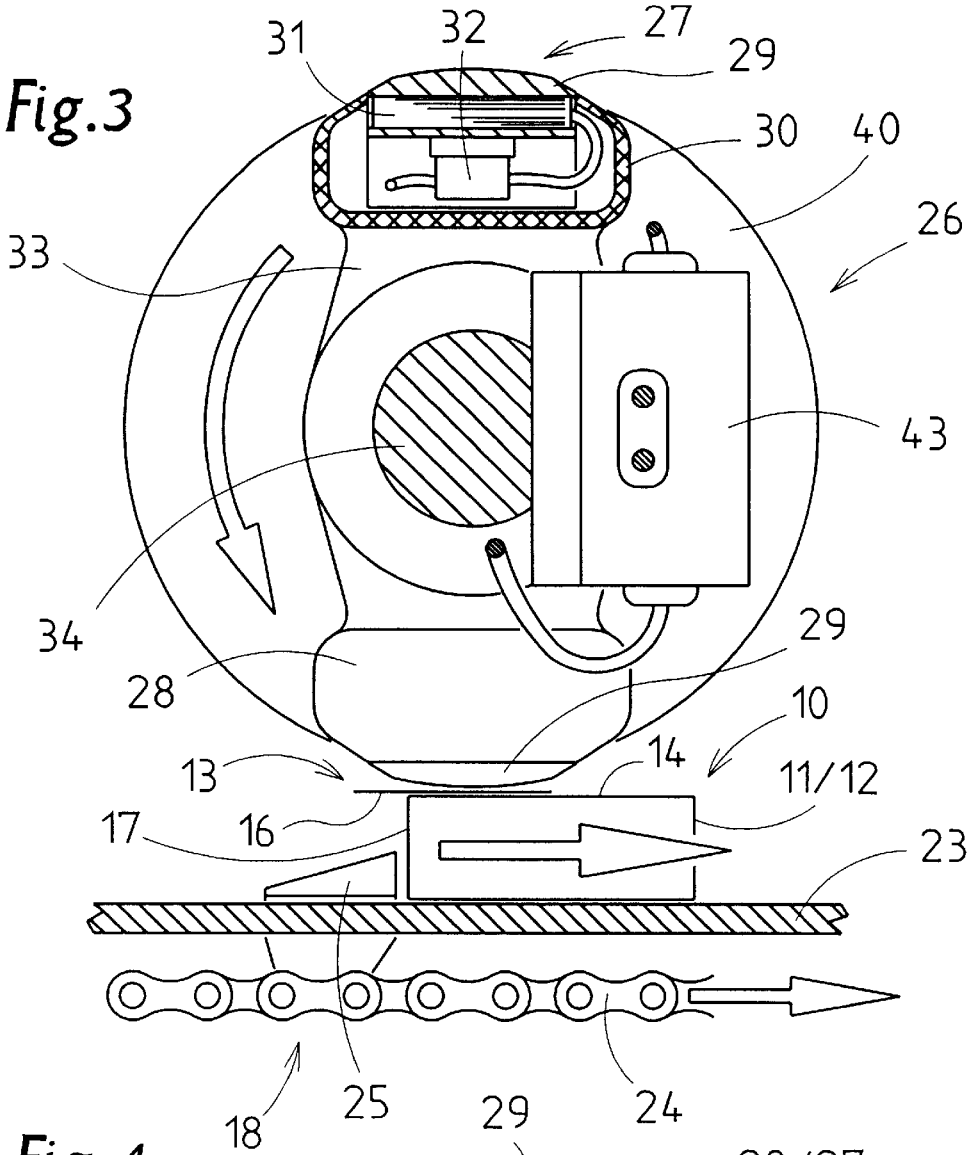
FIG. 3 shows a detail of the pressure-exerting subassembly according to FIG. 2 along a section plane III—III from FIG. 2.

As can be seen from FIG. 2, the exemplary embodiment shown is set up for double-path operation with two pack paths 35, 36 parallel one beside the other. Accordingly, there are provided two pressure-exerting subassemblies 26 which are spaced apart axially and are each assigned to a pack path 35, 36. The two pressure, subassemblies 26 are connected to one another by the shaft 34. The latter, in turn, is driven by a shaft end 37 which is mounted, and driven, in the machine housing 38. The shaft end 37 is connected to the shaft 34 via a releasable coupling 39.

The shaft end 37 has a co-rotating carrying disc 40 arranged on it. Said carrying disc has (two) printed conductors 41 for transmitting power from a fixed power unit 42, which has carbon brushes or other power transmitting elements in sliding contact with the printed conductors 41. The carrying disc 40, in turn, is connected to a connection box 43 via electric lines. Said connection box is part of the rotating subassembly and is connected to the segments 27, 28 and/or the heating cartridges 31 via power lines and control lines. The segments 27, 28 are operated, for example, at 24 V and are heated to a controllable temperature of, for example, 140° C.

Figure 4:
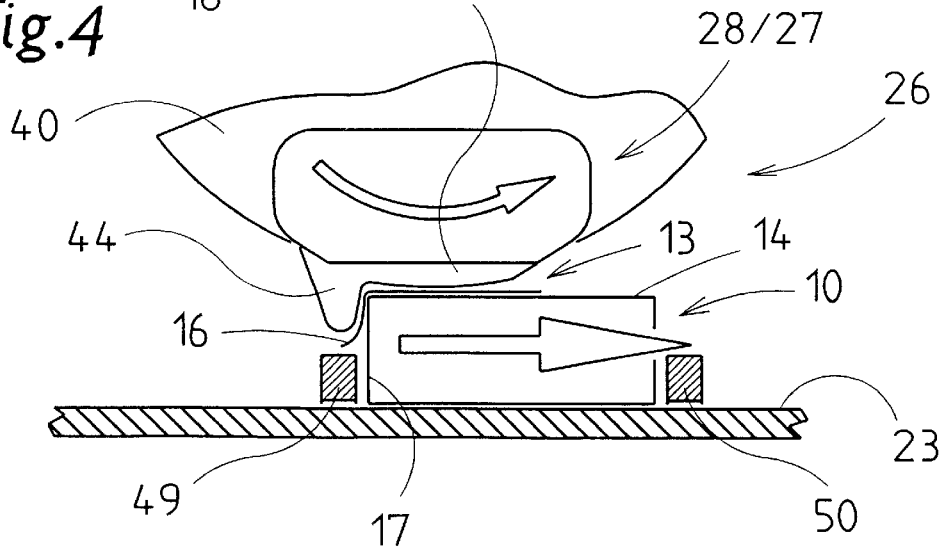
FIG. 4 shows part of the detail according to FIG. 3 for a further exemplary embodiment.

FIG. 4 shows a further special feature as far as the configuration of the segments 27, 28 is concerned. Said segments may carry out the further function of folding the band 13, specifically of folding over the leg 16 against a rear side, as seen in the conveying direction, of the cigarette pack 10, namely the side surface thereof. For this purpose, the pressure-exerting member 29 is provided on the rear side, as seen in the direction of rotation, with a downwardly projecting folding lug 44. The latter is arranged such that, during the rolling-contact movement, the leg 16 is gripped and folded from the horizontal position against the side surface 17.

To ensure that the folding member assigned to the pressure-exerting member 29, namely folding lug 44, is capable of transferring sufficient folding pressure so that a clearly sharp-edged folding line is created in the region of the band 13, counterpressure is applied to the cigarette pack 10. In the present exemplary embodiment according to FIG. 4 this is achieved by holding the cigarette pack 10 in place between holding members, namely between a driver 49 at its rear side and a counterbrace 50 acting upon the opposite, front side surface of the pack 10. The cigarette pack is braced against the counterbrace 50 while the leg 16 is folded around it (during continued conveying motion).

The object of pressing on the bands 13, the transmission of heat and the folding step carried out by the folding lug 44 is to fix the band in its final and correct position on the pack. At high cycle rates and/or when the corresponding glues are employed, the measures described in conjunction with FIG. 4 merely achieve a pre-folding and pre-positioning of the band 13. The actual folding and final fixing occurs in the region of the folding turret 48. When the pack 10 is inserted into this folding turret 48, the pre-folded leg 16, which also may not be lying flat against side surface 17, is pressed against said surface, thus completing the application of the band 13 to the pack 10.

In the preceding exemplary embodiment (FIG. 1), the packs are transferred from the pack conveyor 18 to a lifting platform 51 which lifts each oncoming pack up to the insertion plane of the folding turret 48. A slide 52, which is displaceable in this plane of insertion, makes contact with the pack 10, and conveys the same—while also taking along a blank (not shown) for the outer wrapping of the pack—into a pocket of the folding turret 48. During this insertion, if necessary the leg 16 is pressed against the side surface 17 by the slide 17, therefore completing the folding and positioning of the bands 13.

The heat for setting the glue may be transmitted in some other manner, for example by radiant heat or by hot air, if appropriate in addition to the heated pressure-exerting subassembly 26.

For adjustment and maintenance purposes, it is possible for the pressure-exerting subassembly 26 to be moved by hand, to be precise via a grip 45.

The cigarette packs 10 provided with the band are fed to a film apparatus 46. In the region of the latter, a blank which has been severed from a film web 47 is folded, as an outer wrapper, around the cigarette pack 10, to be precise in the region of a folding turret 48. The latter discharges finished cigarette packs 10.

What is claimed is:

1. Apparatus for producing packs (10) having a band (13) fastened on at least one pack surface by adhesive bonding comprising a band apparatus (19), and that arranged downstream in the conveying direction of the band apparatus (19) is a pressure-exerting subassembly (26) with a movable pressure-exerting element, wherein the pressure-exerting subassembly (26) is arranged above the movement path of the packs (10), it being possible for the band (13) to be applied to an upwardly directed pack side, and in that said movable element comprises a heated pressure-exerting member (29), which can be moved from above, against the pack (10) in the region of the band (13), and wherein said movable element further comprises a housing (30) on which the pressure-exerting member (29) is provided, and a heating element for the pressure-exerting member (29) being arranged within the housing (30), and wherein the movable element is operable due to movement of the movable element to transfer pressure and heat to the pack (10) and the band (13) when pressed against the pack (10) and the band (13) in conjunction with folding a leg (16) of the band (13) projecting from the pack (10).

2. The apparatus of claim 1 wherein said band is applied to a front side of said pack.

3. The apparatus of claim 1 wherein said pressure exerting subassembly includes two rotatable pressure-exerting elements.

4. The apparatus of claim 1 wherein the movable pressure-exerting element is rotatable.

5. Apparatus for producing packs (10) having a band (13) fastened on at least one pack surface by adhesive bonding comprising a pressure-exerting subassembly (26) with a movable pressure-exerting element with a heated pressure-exerting member (29), which can be pressed against the band (13) to be fastened on the pack (10), wherein the pressure-exerting subassembly (26) is arranged above the movement path of the packs (10), it being possible for the band (13) to be applied to an upwardly directed pack side, and wherein said movable pressure-exerting element comprises a housing (30) on which the pressure-exerting member (29) is provided, and a heating element for the pressure-exerting member (29) being arranged within the housing (30), and wherein the movable pressure exerting element is operable due to movement of the movable pressure exerting element to transfer pressure and heat to the pack (10) and the band (13) when pressed against the pack (10) and the band (13) in conjunction with folding a leg (16) of the band (13) projecting from the pack (10).

6. Apparatus for producing cuboid-shaped packs (10) having a band (13) fastened on at least one pack surface by adhesive bonding comprising:

(a) a pack conveyor (18) wherein the packs (10) can be moved in success by means of the pack conveyor (18) past a band dispenser (22) which is arranged above the path of movement of the packs (10) and which attaches a band (13) provided with adhesive to an upwardly directed side of the pack (10);

(b) a pressure-exerting subassembly (26) wherein the pack (10) with the band (13) is moved past the pressure-exerting subassembly (26) arranged above the path of movement of the packs (10);

(c) pressure-exerting member (27, 28) of the pressure-exerting subassembly (26) which by movement of the pressure-exerting assembly (26) temporarily butt against the pack (10) in the region of the band (13) and press the band (13) onto the pack (10), the pressure-exerting members (27, 28) comprising a housing (30) on which a pressure-exerting member (29) is provided, ad arranged within the housing (30) is a heating element with thermostat (32) for the pressure-exerting member (29); and (d) wherein the pressure-exerting members (27, 28) are heated such that when the pressure-exerting member (29) is pressed against the pack (10) and the band (13), pressure and heat can be transferred to the pack (10) and the band (13).

7. Apparatus according to claim 6, wherein the pressure-exerting member (29) has a convex outer surface and can be moved in a rolling-contact movement over the band (13).

8. Apparatus according to claim 6, wherein the pressure-exerting members of the pressure-exerting subassembly (26) are rotating segments (27, 28), and wherein each segment has a heated pressure-exerting member (29) which can be moved from above against the pack (10) in the region of the band (13).

9. Apparatus according to claim 8 further comprising a segment carrier (33), wherein the segment carrier (33) is mounted on a rotary driven shaft (34), wherein arranged on each of the radially outward-directed ends of the segment carrier (33) is a segment (27, 28) with a heated pressure-exerting member (29), and wherein the segments (27, 28) lie diametrically opposite one another.

10. Apparatus according to claim 8, wherein the pressure-exerting member (29) has a folding lug (44), by means of which a leg (16) of the band (13) projecting beyond the rear side of the pack (10) with respect to the conveying direction can be folded against a rear pack surface (17) due to the rolling movement of the pressure-exerting member (29) on the band (13).

11. Apparatus according to claim 10, wherein while the providing leg (16) of the band (13) is folded around the packs (10) against a pack surface facing the rear with respect to the conveying direction, the packs (10) are braced on the opposite side by the side surface facing the front in the conveying direction in order to generate a counterpressure to the folding pressure.

12. Apparatus according to claim 6, wherein the pressure-exerting members (29) of the segments (27, 28) have a convex outer surface and can be moved in a rolling-contact movement over the band (13) while the pack (10) is being conveyed.

13. Apparatus according to claim 6, wherein for double-path operation, two pressure-exerting subassemblies (26) are spaced apart from each other on a common shaft (34) for the purpose of pressing the bands (13) onto the packs (10), which can be moved past simultaneously past the two pressure-exerting subassemblies (26) by means of two parallel pack conveyors (18).

14. Apparatus according to claim 6, wherein the packs (10) are positioned by the pack conveyor (18) in the region of the pressure-exerting subassembly (26) between a rear driver (49) and a front counterbrace (50) relative the conveying direction.

15. Apparatus for producing cuboid-shaped packs (10) having a bend (13) fastened on at least one pack surface by adhesive bonding comprising:

(a) a pack conveyor (18) wherein the packs (10) can be moved in succession by means of the pack conveyor (18) past a band dispenser (22) which is arranged above the path of movement of the packs (10) and which secures a band (13) to an upwardly directed side of the pack (10);

(b) a pressure-exerting subassembly (26) wherein the pack (10) with the band (13) is moved past the pressure-exerting subassembly (26) arranged above the path of movement of the packs (10);

(c) a rotating element of the pressure-exerting subassembly (26) which by movement of the pressure-exerting subassembly (26) temporarily abuts against the pack (10) in the region of the band (13) and presses the band (13) onto the pack (10), the movement of the rotating element synchronized with the conveying speed of the packs, and the rotating element (27,28) having a heated pressure-exerting member (29) which can be moved from above against the pack (10) in the region of the band (13), and (d) wherein the rotating element is operable due to movement of the pressure-exerting subassembly to transfer pressure and heat to the pack (10) and the band (13) when pressed against the pack (10) and the band (13) in conjunction with folding a leg (16) of the band (13) projecting from the pack (10).

16. Apparatus for producing cuboid-shaped packs (10) having a band (13) fastened on at least one pack surface by adhesive bonding comprising:

(a) a pack conveyor (18) wherein the packs (10) can be moved in succession by means of the pack conveyor (18) past a band dispenser (22) which is arranged above the path of movement of the packs (10) and which attaches a band (13) provided with adhesive to an upwardly directed side of the pack (10);

(b) a pressure-exerting subassembly (26) wherein the pack (10) with the band (13) is moved past the pressure-exerting subassembly (26) arranged above the path of movement of the packs (10);

(c) a movable element of the pressure-exerting subassembly (26) which by movement of the pressure-exerting assembly (26) temporarily abuts against the pack (10) in the region of the band (13) and presses the band (13) onto the pack (10), and the movable element having a heated pressure-exerting member (29) that can be moved over the band (13) while the pack (10) is being conveyed; and (d) wherein the movable element is operable to transfer pressure and heat to the pack (10) and the band (13) when pressed against the pack (10) and the band (13) in conjunction with folding a leg (16) of the band (13) projecting from the pack (10) due to movement of the movable element.

17. Apparatus for producing pecks (10) having a band (13) fastened on at least one pack surface by adhesive bonding comprising a band apparatus (19), and that arranged downstream in the conveying direction of the band apparatus (19) is a pressure-exerting subassembly (26) with moveable pressure-exerting elements (27, 28), wherein the pressure-exerting subassembly (26) is arranged above the movement path of the packs (10), it being possible for the band (13) to be applied to an upwardly directed front side of the pack, and in that said elements (27, 28) comprise a heated pressure-exerting member (29), which can be moved, from above, against the pack (10) in the region of the band (13), and wherein said elements (27, 28) further comprises a housing (30) on which the pressure-exerting member (29) is provided, and a heating element with a thermostat for the pressure-exerting member (29), said heating element arranged within the housing (30).

18. Apparatus for producing packs (10) having a band (13) fastened on at least one pack surface by adhesive bonding comprising a pressure-exerting subassembly (26) with movable pressure-exerting elements (27, 28) with a heated pressure-exerting member (29), which can be pressed against the band (13) to be fastened on the pack (10), wherein the pressure-exerting subassembly (26) is arranged above the movement path of the packs (10), it being possible for the band (13) to be applied to an upwardly directed pack side, and wherein said pressure exerting elements (27, 28) comprise a housing (30) on which the pressure-exerting member (29) is provided, and a heating element with a thermostat for the pressure-exerting member (29) being arranged within the housing (30).

19. Apparatus for producing cuboid-shaped packs (10) having a band (13) fastened on at least one pack surface, comprising:

a pack conveyor (18) wherein the packs (10) can be moved in succession by means of the pack conveyor (18) past a band dispenser (22) which is arranged above a path of movement of the packs (10) and which attaches the band (13) to project beyond a rear-facing side surface (17), in the direction of conveyance, to form a leg (16);

a pressure-exerting subassembly (26) wherein the pack (10) with the band (13) is moved past the pressure-exerting subassembly (26) arranged above the path of movement of the packs (10);

an element of the pressure-exerting subassembly (26) adapted to temporarily abut against the pack (10) in the region of the band (13) and press the band (13) onto the pack (10), and the element of the pressure-exerting subassembly (26) having a heated pressure-exerting member (29) with an outer surface that can be moved into contact with he band (13) while the pack (10) is being conveyed, and wherein the pressure-exerting member (29) is operable to transfer pressure and heat to the pack (10) and the band (13) when pressed against the pack (10) and the band (13); and wherein the leg (16) of the band is foldable by a folding lug (44) connected to the pressure-exerting member (29).

* * * * *